US005993558A

United States Patent [19]

Webster, Jr. et al.

[11] Patent Number: 5,993,558

[45] Date of Patent: Nov. 30, 1999

[54] REMOVAL OF FLUORIDE-CONTAINING SCALES USING ALUMINUM SALT SOLUTION

[75] Inventors: George Henry Webster, Jr., Willis; Byron Von Klock, Beaumont, both of Tex.

[73] Assignee: Texaco Inc., White Plains, N.Y.

[21] Appl. No.: 08/890,698

[22] Filed: Jul. 11, 1997

Related U.S. Application Data

[60] Provisional application No. 60/021,889, Jul. 17, 1996.

[51] Int. Cl.[6] ..... B08B 3/08

[52] U.S. Cl. ..... 134/2; 134/26; 134/28; 134/29

[58] Field of Search ..... 134/2, 3, 26, 28, 134/29, 41, 42; 210/699, 701; 252/180

[56] References Cited

U.S. PATENT DOCUMENTS

| | | | |
|---|---|---|---|
| 3,852,123 | 12/1974 | Goltz . | |
| 4,264,463 | 4/1981 | Kotake et al. . | |
| 4,330,419 | 5/1982 | Hall . | |
| 4,361,445 | 11/1982 | Pryor . | |
| 4,692,252 | 9/1987 | Atwood et al. | 210/761 |
| 4,747,975 | 5/1988 | Ritter . | |
| 4,784,774 | 11/1988 | Amjad et al. | 210/699 |
| 4,936,987 | 6/1990 | Persinski et al. | 210/699 |
| 5,016,810 | 5/1991 | Sikka . | |
| 5,254,286 | 10/1993 | Gill et al. | 252/180 |
| 5,407,583 | 4/1995 | Gill et al. | 210/701 |

*Primary Examiner*—Jill Warden
*Assistant Examiner*—Alexander Markoff
*Attorney, Agent, or Firm*—Henry H. Gibson; Rodman & Rodman

[57] ABSTRACT

Fluoride-containing scale can be removed from metal surfaces such as titanium, titanium alloys, nickel alloys, and stainless steel by contacting the metal surfaces with an aqueous salt solution of an inorganic acid, including its hydrates. The cationic portion of the salt can be aluminum, iron and mixtures thereof. The anionic portion of the salt can be a chloride, a nitrate, a sulfate, and mixtures thereof. The contracting occurs in the absence of the addition of an acid, such as hydrochloric, nitric, or sulfuric acid. The presence of the aqueous salt solution with the dissolved fluoride scale does not accelerate or increase the normal rate of metal corrosion that can occur in the absence of the aqueous salt solution or any acidic cleaning agent.

24 Claims, No Drawings

REMOVAL OF FLUORIDE-CONTAINING SCALES USING ALUMINUM SALT SOLUTION

This application claims the benefit of U.S. Provisional application Ser. No. 60/021,889, filed Jul. 17, 1996.

BACKGROUND OF THE INVENTION

1. Field of the Invention

The invention is relates to the removal of scale from metal surfaces, and more particularly, to the removal of scales containing fluorides from metal surfaces.

2. Description of the Prior Art

When coal or other ash-containing organic materials are gasified in a high-pressure, high-temperature partial oxidation quench gasification system, the ash material commonly becomes partitioned between coarse slag, finely divided slag particles, and water-soluble ash components. Water is used in the system to slurry the feed coal, to quench the hot synthesis gas, also referred to as "syngas" and to quench the hot slag byproduct. Water is also used to scrub particulate matter from the syngas, and to assist in conveying the slag byproduct out of the gasifier.

Calcium fluoride and magnesium fluoride scale which forms on evaporator tubes is usually chemically removed by inorganic acids such as sulfuric, hydrochloric, or nitric acids. When sulfuric acid is used for scale removal, $CaSO_4$ is sometimes precipitated. During acid cleaning of fluoride scale, corrosive hydrofluoric acid is formed in the cleaning solution and certain metals and metal alloys, such as titanium, nickel, and stainless steel can become subject to severe corrosion from the hydrofluoric acid. The presence of fluoride ion ($F^-$) in the solution interferes with the protective oxide films that form on these metals and allows for dissolution of the titanium, iron, and nickel ions in an acidic solution. Therefore, chemical cleaning of fluoride scale by the use of acids alone in process equipment is not practical. It is also noted that calcium scale can be chemically removed by use of ethylene diamine tetracetic acid.

Scale can also be removed by mechanical means such as by scraping or by impact with a hammer or by hydroblasting. However, chemical cleaning is preferred and is usually more thorough because scale can be dissolved and removed in places where a hydroblasting nozzle cannot reach. It is therefore desirable to chemically dissolve fluoride scale from equipment constructed of titanium or stainless steel. Titanium and stainless steels are commonly used in the wastewater treatment industry, especially in the construction of wastewater evaporators.

The literature has also addressed the problem of hydrofluoric acid corrosion in process equipment made of stainless steels, nickel alloys and titanium alloys. Koch, G. H., "Localized Corrosion in Halides Other Than Chlorides," *Environment Effects*, June 1993 discloses that ferric or aluminum ions can inhibit corrosion.

The effect of water solutions and their corrosiveness in flue gas desulfurization process scrubbers has also been studied. These solutions contain chlorides, fluorides and sulfates at low pH, for example, 4800 mg/kg fluoride at a pH of 1. The addition of flyash minerals which contain significant amounts of silicon, iron, and aluminum can inhibit corrosion of titanium in otherwise aggressive fluoride containing solutions. It was also found that if 10,000 mg aluminum/kg (added as aluminum sulfate) were added to a corrosive acidic solution containing 10,000 mg/kg chloride and 1,000 mg/kg fluoride, the solution is no longer corrosive to titanium.

SUMMARY OF THE INVENTION

Fluoride-containing scale can be removed from metal surfaces such as titanium, titanium alloys, nickel alloys, and stainless steel by contacting the metal surfaces with an aqueous salt solution of an inorganic acid, including its hydrates. The cationic portion of the salt can be aluminum, iron and mixtures thereof. The anionic portion of the salt can be a chloride, a nitrate, a sulfate, and mixtures thereof. The contacting occurs in the absence of the addition of an acid, such as hydrochloric, nitric, or sulfuric acid. The presence of the aqueous salt solution with the dissolved fluoride scale does not accelerate or increase the normal rate of metal corrosion that can occur in the absence of the aqueous salt solution or any acidic cleaning agent.

DESCRIPTION OF THE PREFERRED EMBODIMENTS

In order to conserve water, gasification system operating units seek to recirculate the process water, usually after a purification treatment, such as removal of the finely divided particulate slag or "slag fines" in a solids settler. Since the gasification reaction consumes water by producing hydrogen in the synthesis gas, there is generally no need to remove water from the system to prevent accumulation. Nevertheless, a portion of the process wastewater, also referred to as the aqueous effluent, grey water, or blowdown water, is usually removed from the system as a purge wastewater stream to prevent excessive buildup of corrosive salts, particularly chloride salts.

As shown in Table 1, which follows, with data from the gasification of high-chloride Eastern U.S. coal, the composition of the wastewater blowdown from the gasification system is fairly complex. For a feedstock with relatively high levels of chloride, the principal wastewater component is ammonium chloride.

TABLE 1

ASH CONTENT OF HIGH-CHLORIDE EASTERN COAL

| | Gasifier Feed Coal (Flow = 71,950 kg/hr) | | Blowdown Water (Flow = 33,208 liters/hr) | | Percentage of Coal |
|---|---|---|---|---|---|
| Ash Species | Concentration | Mass Flow (grams/hr) | Concentration | Mass Flow (grams/hr) | Material In Water |
| Ammonia N | 1.4% | 1007300 | 1500 mg/L | 49812 | 4.95 |
| Sodium | 590 micrograms/gram | 42450.5 | 32 mg/L | 1063 | 2.50 |
| Potassium | 1200 micrograms/gram | 86340 | 12 mg/L | 398 | 0.46 |
| Aluminum | 10000 micrograms/gram | 719500 | 2.3 mg/L | 76 | 0.01 |

TABLE 1-continued

ASH CONTENT OF HIGH-CHLORIDE EASTERN COAL

| Ash Species | Gasifier Feed Coal (Flow = 71,950 kg/hr) Concentration | Mass Flow (grams/hr) | Blowdown Water (Flow = 33,208 liters/hr) Concentration | Mass Flow (grams/hr) | Percentage of Coal Material In Water |
|---|---|---|---|---|---|
| Calcium | 2600 micrograms/gram | 187070 | 20 mg/L | 664 | 0.36 |
| Magnesium | 700 micrograms/gram | 50365 | 4.3 mg/L | 143 | 0.28 |
| Boron | 54 micrograms/gram | 3885.3 | 37 mg/L | 1229 | 31.62 |
| Chloride | 0.2% | 86340 | 2600 mg/L | 86341 | 100.0 |
| Fluoride | 0.019% | 13670.5 | 63 mg/L | 2092 | 15.30 |
| Formate | — | 0 | 770 mg/L | 25570 | — |
| Silicon | 19000 micrograms/gram | 1367050 | 60 mg/L | 1992 | 0.15 |

Some materials found in the ash are partially water soluble, that is, a portion of the material remains in the solid slag or ash fines and a portion dissolves in the water. For example, sodium and potassium compounds dissolve in water as their ions, and remain in solids as sodium minerals. Boron compounds dissolve in water as boric acid and borate ions, and remain in solids as oxidized boron minerals. Aluminum, silicon, calcium and magnesium compounds are primarily insoluble, and fluoride compounds are also primarily insoluble.

Since wastewater blowdown from the gasification system contains salts and other potentially environmentally harmful constituents, treatment is necessary before the water can be discharged. Wastewater treatment for a variety of contaminants can be somewhat elaborate and expensive, therefore, other more economic means for treating the wastewater are desirable.

Distillation of the wastewater or brine under certain conditions is an effective and economical means for recovering relatively pure water from the wastewater. Suitable means for distilling gasification wastewater include falling film evaporation and forced circulation evaporation. This invention provides a means of removing fluoride scale which forms on the metal surfaces of these evaporators, and on any other equipment.

In falling film evaporation, the main system heat exchanger is vertical. The brine to be evaporated is introduced to the top of the heat exchanger tubes and withdrawn from the bottom. The brine is pumped to the top of the tubes from a brine sump located below the heat exchanger tubes. The brine falls downwardly through the tubes as a film on the interior tube walls, receiving heat so that the water contained therein evaporates and forms steam as the brine descends. A mixture of brine and steam exits the bottom of the heat exchanger tubes and enters the brine sump, wherein the water vapor and concentrated liquid brine separate. The steam exits from the top of the brine sump, and the residual concentrated liquid brine collects in the brine sump where it is recirculated by a pump to the top of the heat exchanger tubes. The steam can then be condensed to form a water distillate which can be recycled to the gasification system. Feed water, such as effluent wastewater from the gasification system can be continuously added to the brine sump, and a portion of the concentrated brine is continuously withdrawn for the crystallization and recovery of the concentrated salts contained therein.

In forced circulation evaporation, the main system heat exchanger is horizontal, with liquid brine pumped through the tubes and steam introduced on the shell side of the exchanger to heat the brine. The brine does not boil as it travels through the tubes because there is sufficient pressure therein to prevent boiling. The hot brine exiting the exchanger tubes is then transferred upwardly to a brine sump located above the heat exchanger. As the brine travels upwardly, the pressure drops and the hot brine boils to form a two-phase mixture of concentrated brine and water vapor. When the two-phase mixture enters the brine sump, the water vapor separates from the brine, and exits the sump to a condenser where the water vapor is condensed to form distillate water. The brine is recycled to the evaporator by means of a recirculation pump, with a portion removed as a brine blowdown stream for further salt crystallization and recovery. Also as with the falling film evaporator, feed water is added to the brine sump or to the brine recirculation line.

Although both falling film and forced circulation evaporators are commonly used for water distillation applications, their usability depends on the rate of scale formation and accumulation on the evaporator heat exchanger surfaces. The removal of scale from the evaporator heat exchanger and sump surfaces is very important because scale formation on the equipment surfaces acts as an insulator and must be removed periodically in order to operate the evaporator unit effectively.

The composition of the scale shown in Table 2, which follows, was formed from evaporation of gasification grey water wherein a falling film and a forced circulation evaporator were used in series. The primary scale components are silica ($SiO_2$), calcium fluoride ($CaF_2$), and magnesium fluoride ($MgF_2$).

TABLE 2

COMPOSITION OF TUBE SCALE AND SUMP SCALE FROM BLOWDOWN WATER EVAPORATION

| | Magnesium (weight %) | Silicon (weight %) | Phosphorus (weight %) | Sulfur (weight %) | Calcium (weight %) | Iron (weight %) |
|---|---|---|---|---|---|---|
| Forced Circulation Evaporator Tube Scale | 91 | 2 | 2 | 0 | 3 | 2 |
| Forced Circulation Evaporator Sump Scale | 1 | 80 | 0 | 7 | 8 | 4 |
| Falling Film Evaporator Tube Scale | 3 | 55 | 0 | 2 | 40 | 0 |
| Falling Film Evaporator Sump Scale | 3 | 43 | 1 | 0 | 49 | 4 |

In accordance with the present invention, fluoride scale can be removed from titanium, titanium alloys, nickel alloys, and stainless steel by using an aqueous salt solution of an inorganic acid, including its hydrates. The cationic portion of the salt can be aluminum, iron or mixtures thereof. The anionic portion of the salt can be a chloride, a nitrate, a sulfate, and mixtures thereof. The contacting occurs in the absence of the addition of an acid, such as hydrochloric, nitric, or sulfuric acid. The presence of the aqueous salt solution with the dissolved fluoride scale does not accelerate or increase the normal rate of metal corrosion that can occur in the absence of the aqueous salt solution or any acidic cleaning agent.

Preferred salts are aluminum salt solutions made from aluminum chloride, aluminum sulfate, aluminum nitrate, and their hydrates, and mixtures thereof. Aluminum nitrate is the preferred aluminum salt where the equipment being treated is part of a partial oxidation gasification system, because the spent solution can be returned to the gasification system, and has the least impact on the gasifier feed. The nitrate components of the aluminum nitrate salt become part of the synthesis gas, such as $N_2$, $NH_3$ or CN. In contrast, aluminum chloride adds chloride to the feed in the form of ammonium chloride, and aluminum sulfate adds sulfur and calcium sulfate precipitate in the evaporator.

Although iron salts of inorganic acids can also be used to dissolve fluoride scale, iron salts are generally not as effective as aluminum salts on a molar comparison basis for dissolving fluoride scale and inhibiting fluoride corrosion of titanium in acidic solutions.

The aqueous salt solution of the inorganic acid should have a concentration of about 1% to about 40%, preferably about 15% to about 20% and a temperature of about 32° F. to about 212° F. The salt solution is more effective in dissolving fluoride scale with respect to rate and quantity dissolved if the solution is heated to a temperature of about 100° F. to about 212° F. and preferably to about 175° F. to about 212° F. In a comparison test, scale that dissolved in 90 minutes at 100° F., was able to dissolve in one minute at 175° F.

The aqueous inorganic salt solution is contacted with the scale surface for a time sufficient to effect removal or dissolution of the fluoride scale, which is generally from about 30 minutes to about 24 hours, and preferably from about 1 hour to about 3 hours. A combination of inorganic salt solutions, including solutions of their hydrates can also be used. The initial pH of the aqueous salt solution is generally at least about 1.5.

Before or after the treatment of the metal surface with the aqueous aluminum salt solution of the inorganic acid, a solution of an alkali metal hydroxide such as sodium hydroxide (NaOH) or potassium hydroxide (KOH) can be used to contact and treat the metal surface to remove any silica-containing scale, or iron cyanide scale.

The alkali metal hydroxide treatment, particularly the NaOH treatment, is generally chosen as the first scale cleaning solution, primarily because the caustic solution is less expensive than the aluminum salt solution, particularly the aluminum nitrate solution.

The alkali metal hydroxide solution should have a concentration of about 1% to about 25%, and preferably about 2% to about 6%, and should be heated to a temperature of about 170° F. to about 212° F., or to the boiling point of the solution at atmospheric pressure. The alkali metal hydroxide solution should be contacted with the scale surface for a time sufficient to effect removal of the silica or iron cyanide scale, which is generally from about 30 minutes to about 24 hours, and preferably about 2 hours to about 6 hours. A mixture of sodium hydroxide and potassium hydroxide can also be used. A sodium nitrate inhibitor is generally used with the caustic when scale is removed from titanium.

After the caustic cleaning operation has been completed, the caustic solution should be removed from the equipment, such as by draining it therefrom, before introducing the aqueous inorganic salt solution, and vice-versa. No special cleansing is necessary after removal of each cleaning solution. Thus, the next cleaning solution, that is, the aqueous inorganic salt solution can be introduced into the equipment and removed in similar fashion.

The combined spent neutralized solutions of the sodium hydroxide and the aqueous inorganic salt solution can be combined, diluted with water to a concentration of about 95% water and neutralized to a pH of about 7 using additional sodium hydroxide, if necessary.

The neutralized spent cleaning solution can then be used to slurry a feedstock, such as coal, for a partial oxidation reaction. Thus, for example, fluoride, sodium, aluminum and silicon constituents become components of the byproduct slag. If the spent alkali solution is recycled to the gasifier, the recycled solution should be added in small quantities to the feedstock so as not to increase sodium or potassium feed concentrations significantly which can have an adverse effect on the refractory lining of the gasifier. An unneutralized spent aluminum salt solution can be recycled to the gasifier feed as long as it is blended with the feedstock at a low enough rate so that the pH of the feedstock is not reduced below 6.0.

It is noted that by use of the aqueous salt solution without an acid, instead of using an inorganic acid cleaning solution with an added aluminum salt, the cleaning process does not accelerate corrosion or increase the corrosion rate, whereas with an acid, care must be used to add enough aluminum inhibitor to reduce or halt the acceleration of corrosion. Since, the amount of scale in the equipment is not exactly known prior to cleaning and there is an economic need to conserve chemical cleaning solutions, this is a significant consideration.

The means for determining whether more cleaning solution needs to be added to the equipment can be determined by a total dissolved solids analysis in which a filtered cleaning solution is taken from the equipment being treated and dried at 105° C. and the residue weight measured.

The total dissolved solids concentration of the initial cleaning solution and the cleaning solution in contact with the scale can be used to determine if the cleaning solution is saturated with scale compounds. A molar ratio of 0.5 silica to alkali hydroxide and a molar ratio of 1.3 calcium fluoride to aluminum salt solution should be used in determining the saturation point of the cleaning solution. In this way, the amount of cleaning solution used can be minimized.

In the examples, and throughout the specification, all concentrations are in weight percent, unless otherwise specified.

EXAMPLES 1–6

Blowdown water of the composition in Table 1 is evaporated in a falling film evaporator to produce a mixture of water vapor and brine. This mixture is fed to the brine sump of a falling film evaporator where the water vapor is separated from the brine and fed to a condenser to recover the water distillate. After operation of the evaporator for about 42 days, scale develops on the titanium surface inside the evaporator tubes and on the surface of the Hastelloy™ C-276 (Haynes Metals Co.) high nickel alloy that forms the sump.

The scale is mechanically removed from the metal surface of the brine sump by peeling flakes from the surface and from the evaporator tubes by impacting the outside of the titanium tubes with a hammer. The composition of the scale is approximately 50% amorphous silica and 50% calcium fluoride. Separate 6 gram samples of the scale are initially contacted with 100 grams of a sodium hydroxide solution having a concentration of 6% or 10% at a temperature of 170° F. for at least 2 hours. After the treatment period the caustic solution is analyzed by the Inductively Coupled Plasma (ICP) Instrument Method for metals and ion chromatography for fluoride, and the weight of Si, Ca and F dissolved by the caustic solution is determined.

The scale sample is then contacted with a solution of aluminum nitrate (11.2%, 12% or 16%) at a pH of 1–2 and a temperature of 100° F. or 170° F. for at least 2 hours. In EXAMPLES 4–6, the aluminum nitrate solution also contains 0.5 or 1% sodium nitrate ($NaNO_3$) which is used to inhibit hydride phase formation in titanium. After the treatment period the aluminum nitrate solution is analyzed by ICP Methods for metal and ion chromatography for fluoride and the weight of Si, Ca and F dissolved by the aluminum nitrate solution is determined. The examples show that a fluoride containing scale is effectively removed using aluminum nitrate solutions, with over 90% scale removal accomplished in Examples 1, 4 and 6. The results are recorded in Table 3, which follows.

TABLE 3

FALLING FILM EVAPORATOR SUMP SCALE REMOVAL

| | | CAUSTIC TREATMENT | | | | | |
|---|---|---|---|---|---|---|---|
| Example | Solution | Time (hour) | Temp (°F.) | Si Dissolved (% of initial scale weight) | Ca Dissolved (% of initial scale weight) | F Dissolved (% of initial scale weight) | Molar Ratio of Si dissolved to NaOH in cleaning solution |
| 1 | 6% NaOH-11.2% $Al(NO_3)_3$ | 2 | 170 | 30 | 0 | 3 | 0.43 |
| 2 | 6% NaOH-11.2% $Al(NO_3)_3$ | 2.5 | 170 | 20 | 0 | 1.5 | 0.29 |
| 3 | 10% NaOH (1% $NaNO_3$)-11.2% $Al(NO_3)_3$ | 4 | 170 | 7.7 | 0 | 3.7 | 0.064 |
| 4 | 10% NaOH (1% $NaNO_3$)-16% $Al(NO_3)_3$ | 5.3 | 170 | 10 | 0 | 5.5 | 0.089 |
| 5 | 10% NaOH (0.5% $NaNO_3$)-12% $Al(NO_3)_3$ | 5.8 | 170 | 9.1 | 0 | 3.7 | 0.097 |
| 6 | 10% NaOH (0.5% $NaNO_3$)-16% $Al(NO_3)_3$ | 5.5 | 170 | 7.6 | 0 | 3.6 | 0.086 |

NOTE:

Maximum capacity of NaOH solution is to dissolve 0.5 moles of Si for every mole of NaOH (2 moles of NaOH are required to form 1 mole of sodium silicate). Solution is completely utilized when ratio of Si to NaOH is 0.5.

Maximum capacity of $Al(NO_3)_3$ solution at 100° F. is to dissolve approximately 1.3 moles of fluoride (0.65 moles $CaF_2$) for every mole of aluminum (previously determined in $CaF_2$ dissolution tests). Solution is completely utilized when ratio of fluoride to aluminum is 1.3 or ratio of fluoride to $NO_3$ is 0.43. At 174° F. 1.6 moles of fluoride (0.8 moles $CaF_2$) is dissolved per mole of aluminum.

TABLE 3-continued

FALLING FILM EVAPORATOR SUMP SCALE REMOVAL

| | | NITRATE TREATMENT | | | | | |
|---|---|---|---|---|---|---|---|
| Example | Solution | Time (hour) | Temp (°F.) | Si Dissolved (% of initial scale weight) | Ca Dissolved (% of initial scale weight) | F Dissolved (% of initial scale weight) | Molar Ratio of F dissolved to $NO_3$ in cleaning solution |
| 1 | 6% NaOH-11.2% $Al(NO_3)_3$ | 2 | 100 | 0.4 | 15 | 15 | 0.28 |
| 2 | 6% NaOH-11.2% $Al(NO_3)_3$ | 6.3 | 100 | 0.1 | 21 | 14 | 0.26 |
| 3 | 10% NaOH (1% $NaNO_3$)-11.2% $Al(NO_3)_3$ | 4 | 100 | 0.3 | 22 | 17 | 0.32 |
| 4 | 10% NaOH (1% $NaNO_3$)-16% $Al(NO_3)_3$ | 6 | 100 | 0 | 25 | 27 | 0.33 |
| 5 | 10% NaOH (0.5% $NaNO_3$)-12% $Al(NO_3)_3$ | 3.5 | 170 | 0.2 | 21 | 22 | 0.28 |
| 6 | 10% NaOH (0.5% $NaNO_3$)-16% $Al(NO_3)_3$ | 1 | 170 | 0.2 | 21 | 18 | 0.26 |

| | | RESIDUE COMPOSITION | | | | | | |
|---|---|---|---|---|---|---|---|---|
| Example | Description | Residue after Caustic Cleaning as a % of Initial Scale Weight | Residue after Acid Cleaning as a % of initial Scale Weight | SI | O | Ca | F | Al |
| 1 | 6% NaOH-11.2% $Al(NO_3)_3$ | 51 | 8 | 37 | 51 | 4 | 0 | — |
| 2 | 6% NaOH-11.2% $Al(NO_3)_3$ | 55 | 22* | 35 | 53 | 6 | 0 | — |
| 3 | 10% NaOH (1% $NaNO_3$)-11.2% $Al(NO_3)_3$ | — | 20** | 8 | 0 | 50 | 23 | — |
| 4 | 10% NaOH (1% $NaNO_3$)-16% $Al(NO_3)_3$ | 73 | 6 | 31 | 46 | 1 | 0 | — |
| 5 | 10% NaOH (0.5% $NaNO_3$)-12% $Al(NO_3)_3$ | 71 | 21*** | 14 | 30 | 1 | 22 | 29 |
| 6 | 10% NaOH (0.5% $NaNO_3$)-16% $Al(NO_3)_3$ | 74 | 7*** | 6 | 30 | 4 | 26 | 26 |

*The residue from Ex. 2 was subjected to further successive cleanings using fresh solutions of $Al(NO_3)_3$ and NaOH until all the scale was completely dissolved. The following results were obtained and are presented in order of succession with the solution concentration, time, temperature, and percent residue after cleaning. 3rd Cleaning - 11.2% $Al(NO_3)_3$- 3 hrs - 14%; 4th Cleaning - 11.2% $Al(NO_3)_3$ - 6 hrs - 13%; 5th Cleaning - 2% NaOH - 2 hrs - 6%; 6th Cleaning - scale.

**The residue from Ex. 3 was subjected to 3.2 g of 10% NaOH - 1% $NaNO_3$ at 170° F. for 5.5 hrs. and the residue was reduced to 12% (the primary component of this reside was $CaF_2$).

***X-ray diffraction analyses showed this residue to predominantly contain $Al_2(OH)_3F_3$.

EXAMPLE 9

Two aqueous solutions, designated "A" and "B" are prepared containing 1% fluoride from calcium fluoride powder, and 4% aluminum chloride added as a corrosion inhibitor. A 1% concentration of hydrochloric acid is also added to solution A. Both solutions are heated to 100° F. and contacted with grade 2 titanium for 24 hours. The corrosion rates and other data are recorded in Table 4.

TABLE 4

| | HCl concentration | Solution pH (initial) | Solution pH (final) | Titanium corrosion rate (mils/year) |
|---|---|---|---|---|
| Solution A | 1% | 0.3 | 0.4 | 636.6 |
| Solution B | — | 2.7 | 3.3 | 0.8 |

An acceptable corrosion rate would be less than about 10 mils/year, and preferably less than about 5 mils/year. The solution A corrosion rate is very high and would result in substantial metal loss. It is evident that the use of an acid solution to dissolve fluoride scale, even with corrosion inhibitor, can result in disastrous corrosion when cleaning fluoride scale from titanium using an acid.

The problem with using an acid cleaner is that the amount of fluoride scale in the unit is not known ahead of time. Therefore, the amount of aluminum corrosion inhibitor would have to be extremely overdosed as a precautionary measure. By use of the aluminum salt solution without an acid, the fluoride scale is dissolved and the titanium corrosion rates are acceptably low.

What is claimed is:

1. A process for removing fluoride containing scale consisting essentially of silica, calcium fluoride and magnesium fluoride as primary scale components from a metal surface selected from the group consisting of titanium, titanium alloys and stainless steel which does not accelerate the rate of metal corrosion above about 10 mils/year which comprises contacting the metal surface with a sufficient amount of an aqueous salt solution of an organic acid, including its hydrates at a temperature of about 32° F. to 212° F., to dissolve the fluoride-containing scale from the metal surface into the aqueous salt solution, wherein the cationic portion of the salt is selected from the group consisting of aluminum, iron and mixtures thereof, and wherein the anionic portion of the salt is selected from the group consisting of chloride, nitrate, sulfate, and mixtures thereof, and wherein said contacting occurs in the absence of the addition of an acid, and wherein the equivalent amount of the scale from the metal surface dissolved in an amount of an acid solution equal to said amount of the aqueous salt solution is sufficient to cause corrosion to the metal surface at a rate greater than 10 mils/year.

2. The process of claim 1, wherein the contacting of the aqueous salt solution with the metal surface and its presence with dissolved fluoride scale does not increase the normal rate of corrosion of said metal that can occur in the absence of the aqueous salt solution or any acidic cleaning agent.

3. The process of claim 1, wherein the initial pH of the aqueous salt solution is at least 1.5.

4. The process of claim 1 wherein the aqueous salt solution is contacted to the metal surfaces for about 30 minutes to about 24 hours.

5. The process of claim 1 wherein the metal surfaces comprise evaporator heat exchanger tubes having scale deposited thereon from contact with wastewater blowdown from a partial oxidation gasification plant.

6. The process of claim 5, wherein the partial oxidation gasification utilizes a fluoride-containing feedstock.

7. The process of claim 1, wherein the aqueous salt solution is completely utilized when the ratio of fluoride to aluminum is 1.3:1, respectively.

8. The process of claim 1, wherein the aqueous salt solution comprises at least one aluminum salt selected from the group consisting of aluminum nitrate, aluminum sulfate and aluminum chloride.

9. The process of claim 8, wherein the aluminum salt is aluminum nitrate.

10. The process of claim 8, wherein the aluminum salt is aluminum sulfate.

11. The process of claim 8, wherein the aluminum salt is aluminum chloride.

12. The process of claim 1, wherein the concentration of the aqueous salt solution of the inorganic acid is about 1% to about 40%.

13. The process of claim 12, wherein concentration of the aqueous salt solution of the inorganic acid is about 15% to about 20%.

14. The process of claim 1, wherein temperature of the aqueous salt solution of the inorganic acid is about 32° to about 212° F.

15. The process of claim 8, wherein an alkali metal hydroxide solution is contacted to the metal surface prior to or after the contacting of the aqueous solution of the aluminum salt or the hydrate of the aluminum salt.

16. The process of claim 15 wherein the alkali metal hydroxide solution is contacted to the metal surfaces for about 2 to about 6 hours.

17. The process of claim 15, wherein the concentration of the alkali metal hydroxide solution varies from about 1% to about 25%.

18. The process of claim 15, wherein the contacting temperature of the alkali metal hydroxide varies from about 170° F. to about 212° F.

19. The process of claim 15, wherein after completion of the contacting of the aluminum salt solution of an inorganic acid or hydrate, and completion of the contacting of the alkali metal hydroxide solution, a spent solution of the alkali metal hydroxide is formed and a spent solution of the aluminum salt of an inorganic acid or hydrate is formed, and the spent alkali metal hydroxide solution and the spent solution of the aluminum salt of an inorganic acid or hydrate are combined and fed to a gasifier in a partial oxidation gasification system.

20. The process of claim 12, wherein the salt of the inorganic acid is an aluminum salt.

21. The process of claim 13, wherein the salt of the inorganic acid is an aluminum salt.

22. The process of claim 14, wherein the temperature of the aqueous salt solution of the inorganic acid varies from about 170° F. to the boiling point of the solution at atmospheric pressure.

23. The process of claim 1, wherein after completion of the contacting operation, a spent solution of the aqueous salt solution of the inorganic acid is formed, and said spent aqueous salt solution of the inorganic acid is fed to a gasifier in a partial oxidation system.

24. The process of claim 1, wherein the saturation point of the aqueous salt solution of the inorganic acid, including its hydrates, is determined by a total dissolved solids analysis.

* * * * *